United States Patent [19]

Rhodes

[11] Patent Number: 4,526,552

[45] Date of Patent: Jul. 2, 1985

[54] ANIMATED FIGURE TOY HAVING A TELESCOPING APPENDAGE

[75] Inventor: Tony Rhodes, Torrance, Calif.

[73] Assignee: Mattel, Inc., Hawthorne, Calif.

[21] Appl. No.: 566,743

[22] Filed: Dec. 29, 1983

[51] Int. Cl.[3] ..... A63H 3/36

[52] U.S. Cl. ..... 446/320; 446/338

[58] Field of Search ..... 446/320, 330, 378, 390, 446/391, 376, 338, 352, 268, 368

[56] References Cited

U.S. PATENT DOCUMENTS

| | | | |
|---|---|---|---|
| 1,196,649 | 8/1916 | Bockstahler . | |
| 1,683,561 | 9/1928 | Letson . | |
| 1,918,122 | 7/1933 | Naue . | |
| 2,334,290 | 11/1943 | Richter | 46/119 |
| 2,623,329 | 12/1952 | DiLeva | 46/161 |
| 2,741,870 | 4/1956 | Lang | 46/119 |
| 2,968,122 | 1/1961 | Wescott | 46/145 |
| 2,990,643 | 7/1961 | Zoeller | 46/3 |
| 3,797,166 | 3/1974 | Murray | 46/119 |
| 3,986,295 | 10/1976 | Keller | 46/119 |
| 4,226,045 | 10/1980 | Lehmann et al. | 446/320 X |
| 4,246,722 | 1/1981 | Sapkus et al. | 446/320 |

FOREIGN PATENT DOCUMENTS

| | | | |
|---|---|---|---|
| 810368 | 8/1951 | Fed. Rep. of Germany | 446/320 |

*Primary Examiner*—Mickey Yu

*Attorney, Agent, or Firm*—Ronald M. Goldman; James G. O'Neill

[57] ABSTRACT

An animated figure toy (10) includes an upper torso (14) provided with a neck opening (28) in which an elongated neck-and-head assembly (18) is reciprocably mounted for reciprocation by a twisted blade (52) affixed to a lower torso (16) and riding in a slot (54) provided in the lower end of neck-and-head assembly (18).

2 Claims, 4 Drawing Figures

18

10
4
4
68
28
46
52
72
70
68
44
42
68
40
48
54
56
68
12
50
36
69
14
34
66
30
58
32
68
68
68
16

ANIMATED FIGURE TOY HAVING A TELESCOPING APPENDAGE

DESCRIPTION

1. Technical Field

The present invention relates to animated figure toys and more particularly to a new and useful animated figure toy having a telescoping appendage.

2. Background Art

The prior art, U.S. Pat. No. 1,196,649, discloses a figure toy comprising a rubber toy which, when compressed, will act to advance or withdraw a figure head or the like from the body of the toy.

Additionally, U.S. Pat. No. 1,683,561 discloses a figure toy having a head mounted to the upper end of a rotatable and longitudinally-movable shaft. The shaft enters a neck opening in the top of the toy and extends to a position adjacent the bottom of the toy. The shaft is attached to a push button in a manner such that the push buttom may be used to elevate and rotate the shaft.

U.S. Pat. No. 1,918,122 discloses a mechanical figure toy which may be collapsed by compressing the parts against spring tension; the collapsed figure is confined within a container having a releasable cover in a manner such that the figure will jump from the container under the force of the springs when the cover is released.

U.S. Pat. No. 2,334,290 discloses an animated figure toy in which the head may be actuated to simulate both knodding and shaking of the head.

U.S. Pat. No. 2,623,329 discloses a doll which is provided with extensible members, for example, with an extensible neck and with extensible limbs, in such a manner that the length of these members can be easily changed, thereby making possible changes in the appearance of the doll, in its size and in its proportions.

U.S. Pat. No. 2,741,870 discloses a growing figure toy having a body which may be elongated by stroking a push button connected to a rack and pinion mechanism.

U.S. Pat. No. 2,968,122 discloses an air-filled toy figure which has a body portion and parts adapted to snap out of the body portion when the toy is squeezed, and to snap back into the body portion when the squeezing pressure is released.

U.S. Pat. No. 2,990,643 discloses a toy bank. As a coin is deposited in the bank, a mechanism is rendered operative to release a latch and enable a spring to eject at least a portion of a figuring upwardly in a direction to attrack the attention of a child.

U.S. Pat. No. 3,797,166 discloses a figure toy which is readily expandable in height from a contracted short size. A lazy tong construction fitted with a spring is employed.

U.S. Pat. No. 3,986,295, which is assigned to the assignee of the instant application, discloses a figure toy having an arm rotatably mounted to a torso; a hand carried on a shaft, which shaft is received within the hollow of the arm; means located within the hollow of the arm for latching said shaft in a first position and biasing means located within the hollow of said arm for urging said shaft forward out of said hollow arm; and means responsive to manual actuation of a torso portion for unlatching said shaft to cause said hand to extend to a position remote from the end of said arm. A gauntlet of a sleevelike nature surrounds the arm and is coupled at an end to the hand so as to obstruct visibility of said shaft when said hand is in the extended position to thereby simulate an increase in length of said arm. Specific novel structure in the provided means is also disclosed.

DISCLOSURE OF INVENTION

In accordance with the present invention, a new and useful animated figure toy is provided with a telescoping appendage. The figure toy includes an upper torso, a lower torso and means rotatably connecting the lower torso to the upper torso; one of said upper and lower torsos is provided with an opening. The figure toy includes an elongated member movably mounted in the opening.

The figure toy also includes a mechanism for coupling one of the upper and lower torsos to the elongated member in a manner such that the elongated member is caused to move outwardly through the opening when the torsos are rotated with respect to each other.

BRIEF DESCRIPTION OF THE DRAWINGS

Details of the present invention will be described in connection with the accompanying drawings wherein.

BEST MODE FOR CARRYING OUT THE INVENTION

Figure 1:
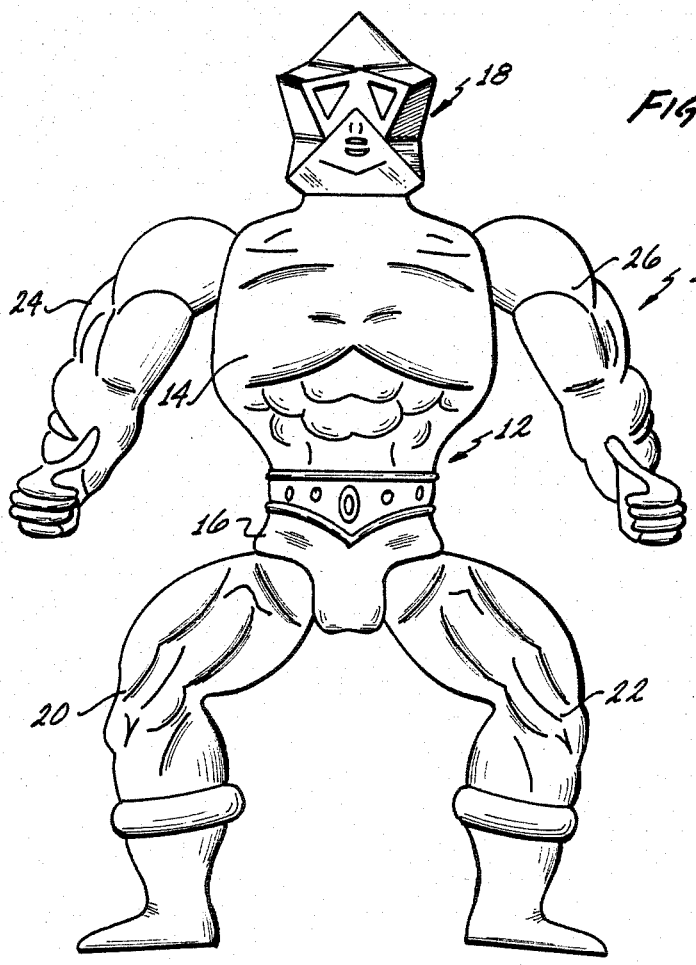
FIG. 1 is a front elevational view of an animated figure toy constituting a presently-preferred embodiment of the invention.

Referring again to the drawings, a figure toy constituting a presently-preferred embodiment of the invention, generally designated 10, includes a body 12 comprising an upper torso 14 and a lower torso 16 which may be rotated with respect to each other.

Figure toy 10 also includes an elevatable head-and-neck assembly or appendage 18, a right leg or appendage 20, a left leg or appendage 22, a right arm or appendage 24 and a left arm or appendage 26.

Figure 4:
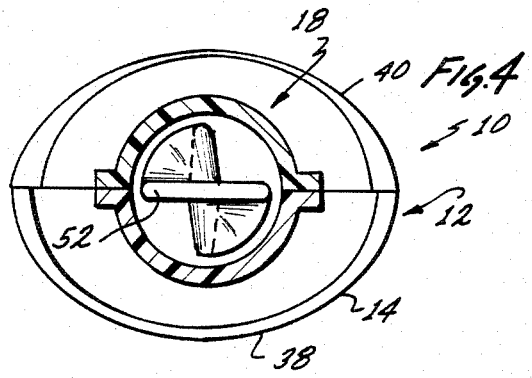
FIG. 4 is an enlarged cross-sectional view taken along line 4—4 of FIG. 2.
Figure 2:
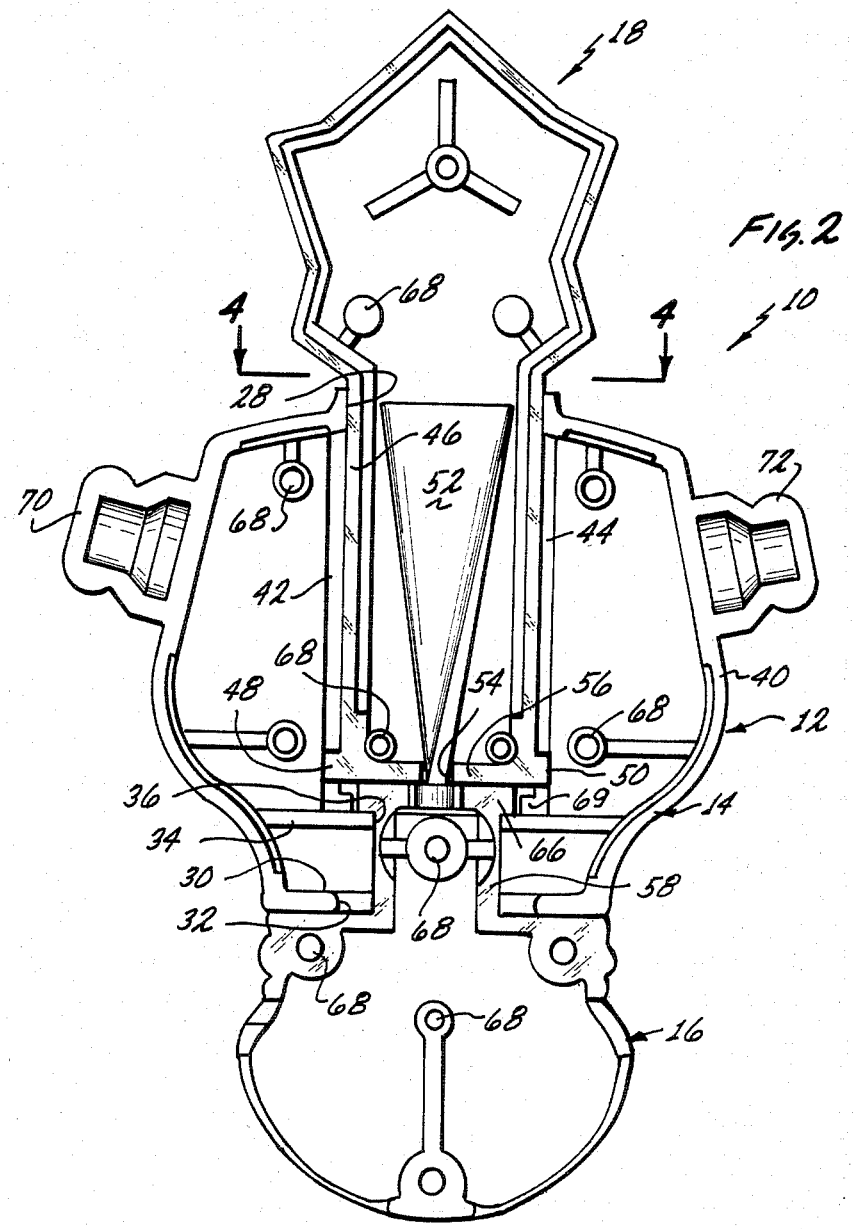
FIG. 2 is a view similar to FIG. 1, but with the limbs and front body portion removed to show internal construction.
Figure 3:
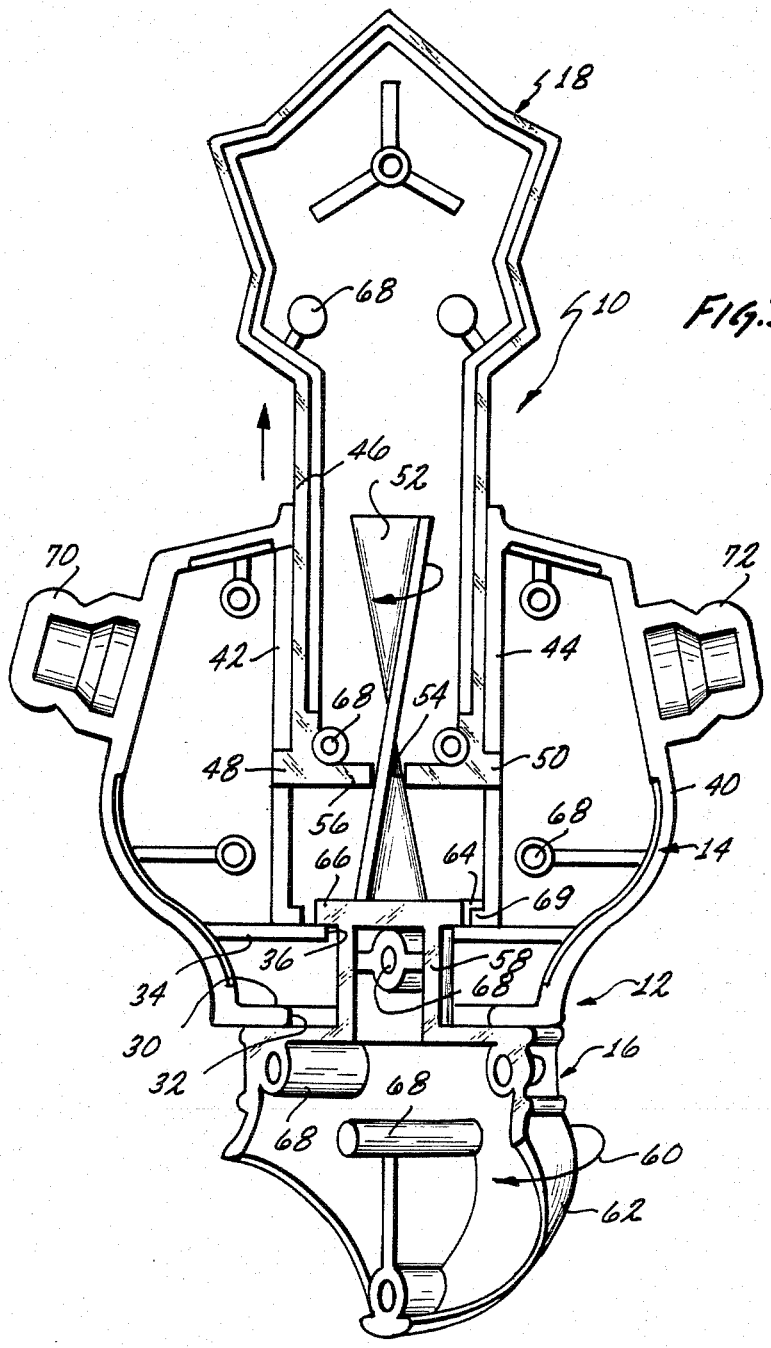
FIG. 3 is a view similar to FIG. 2, but with the lower torso rotated with respect to the upper torso, whereby the elongated member has been moved outwardly through an opening in the body.

Referring now to FIGS. 2 and 3, upper torso 14 is provided with a neck opening 28 and includes a bottom wall 30 in which an aperture 32 is provided. A horizontal partition 34, which is provided with an aperture 36, is suitably mounted to the inside wall of upper torso 14 above bottom wall 30. Upper torso 14 includes a front torso half 38 (FIG. 4) and a rear torso half 40 in each of which is mounted a pair of spaced-apart vertical partitions, as shown at 42, 44 for the rear torso half 40. These vertical partitions form guides for the elongated neck portion 46 at the lower end of which is provided a pair of outwardly-extending gibs 48, 50 riding in a way formed by a small clearance between the vertical partitions 42, 44 of the rear upper torso half 40 and the vertical partitions in the front upper torso half 38. Thus, elongated neck portion 46 is telescopically mounted in neck opening 28 for movement between the lower position shown in FIG. 2 and the elevated position shown in FIG. 3. This movement may be accomplished by a twisted blade 52 upstanding from lower torso 16 and riding in a slot 54 provided in the bottom wall portion 56 of elongated neck 46.

Lower torso 16 is rotatably connected to upper torso 14 by a cylindrical boss 58 whereby head-and-neck assembly 18 may oe elevated to the position shown in FIG. 3 by rotating the lower torso 16 counterclockwise in the direction of arrow 60. The rear half 62 of lower torso 16, boss 58 and blade 52 may be intregally molded from a suitable polymeric material, together with a stop member 64 which is provided on the large-diameter portion 66 of boss 58. The rear half 62 of lower torso 16 and the rear half of boss 58 may be provided with suitable pin-and-socket-type connectors 68 for connecting their associated front halves thereto. Stop member 64 is adapted to engage a stop member 69 adjacent the lower end of partition 40 to prevent the turning of lower torso 14 more than about 90 degrees.

The upper torso 14 may be provided with a pair of outwardly-extending protuberances 70, 72 for receiving arms 24, 26 respectively. Head-and-neck assembly 18 and upper torso 14 may also be provided with pin-and-socket-type connectors 68 for connecting their associated front halves thereto. Upper torso 14 and head-and-neck assembly 18 may also be molded from suitable polymeric materials.

While the particular animated figure toy herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims.

I claim:

1. In combination with a figure toy having an upper torso, a lower torso and means rotatably connecting said lower torso to said upper torso, said upper torso being provided with a neck opening, the improvement which comprises:

an elongated neck movably mounted in said neck opening, said elongated neck including an upper and a lower end, said lower end of said neck normally extending to a position adjacent said lower torso and including a bottom wall having an elongated slot provided therein;

a figure toy head affixed to said upper end of said elongated neck; and means coupling said torsos in said lower torso, said coupling means including a twisted blade engaged in said elongated slot and extending into said elongated neck, said twisted blade being affixed to said lower torso for rotation therewith, whereby said elongated neck is caused to move upwardly away from said lower torso and through said neck opening when said upper and lower torsos are rotated with respect to each other.

2. In combination with a figure toy having an upper torso, a lower torso and means rotatably connecting said lower torso to said upper torso, said upper torso being provided with a neck opening and including a bottom wall in which an aperture is provided, the improvement which comprises:

an elongated neck-and-head assembly movably mounted in said neck opening, said elongated neck-and-head assembly including an upper end and a lower end, said lower end of said neck-and-head assembly normally extending to a position adjacent said lower torso and including a bottom wall portion in which a slot is provided;

a horizontal partition mounted to said upper torso adjacent said upper torso bottom wall, said horizontal partition being provided with an upper surface and an aperture in alignment with said aperture in said upper torso bottom wall;

at least one way mounted in said upper torso, said at least one way extending from said horizontal partition to said neck opening;

at least one outwardly-extending gib affixed to said elongated neck-and-head assembly in sliding engagement with said at least one way;

means coupling said lower torso to said elongated neck-and-head assembly including a boss affixed to said lower torso and rotatably mounted in said aligned apertures in said upper torso, said boss including a large-diameter portion riding on said upper surface portion of said horizontal partition; and a slot provided in said neck-and-head assembly, a twisted blade riding in said slot, and means affixing said twisted blade to said boss on said lower torso, whereby said elongated neck-and-head assembly is caused to move upwardly away from said lower torso and through said neck opening by said twisted blade when said lower torso is rotated with respect to said upper torso.

* * * * *